United States Patent [19]

Woodruff

[11] 4,447,012

[45] May 8, 1984

[54] PORTABLE REEL JACK STAND

[76] Inventor: Harold F. Woodruff, 2340 Avocado Ter., Hacienda Heights, Calif. 91745

[21] Appl. No.: 242,982

[22] Filed: Mar. 12, 1981

[51] Int. Cl.[3] ..... B65H 23/06; B65H 75/40

[52] U.S. Cl. ..... 242/54 R; 242/75.4; 242/79; 242/86.7; 414/458; 414/911

[58] Field of Search ..... 242/54 R, 58.6, 78.6, 242/79, 86.7, 86.52, 86.5 R, 85, 75.4; 414/911, 458, 459, 427

[56] References Cited

U.S. PATENT DOCUMENTS

| | | | |
|---|---|---|---|
| 1,693,876 | 12/1928 | Unruh, Jr. | 242/75.4 |
| 1,825,218 | 9/1931 | Van Hook | 242/54 R |
| 1,832,446 | 11/1931 | Boe | 242/85 |
| 1,874,904 | 8/1932 | Crafts . | |
| 2,176,551 | 10/1939 | Solem | 16/44 |
| 2,215,651 | 9/1940 | Pierce | 242/54 R |
| 2,613,389 | 10/1952 | Cramer | 16/44 |
| 2,650,771 | 9/1953 | Marion | 242/54 R |
| 2,652,207 | 9/1953 | Goedken | 242/58.6 |
| 2,714,463 | 8/1955 | Fraser | 414/607 |
| 2,891,764 | 6/1959 | Pearne | 254/1 |
| 3,120,358 | 2/1964 | Ensley | 242/58.6 X |
| 3,374,964 | 3/1968 | Carvotta | 242/58.6 X |
| 3,404,794 | 10/1968 | Wilson | 414/458 X |
| 3,586,256 | 6/1971 | Wellman | 242/86.7 |
| 3,690,492 | 9/1972 | Shore . | |
| 3,913,854 | 10/1975 | McClure | 242/75.4 |
| 3,930,585 | 1/1976 | Lynch | 414/607 |
| 3,944,094 | 3/1976 | Compton | 414/458 |
| 3,995,758 | 12/1976 | Kovaleski | 414/426 |
| 4,025,006 | 5/1977 | Turnbow | 242/86.5 R |
| 4,030,704 | 6/1977 | Beierle et al. | 242/85 X |
| 4,085,904 | 4/1978 | McElroy | 242/54 R |
| 4,098,468 | 7/1978 | Skalleberg | 242/54 R |
| 4,127,241 | 11/1978 | Conti | 242/156.2 |
| 4,325,522 | 4/1982 | Sauber | 242/86.7 |

*Primary Examiner*—John M. Jillions
*Attorney, Agent, or Firm*—Jeffrey G. Sheldon

[57] ABSTRACT

A portable reel jack stand has dual reel support units which are oppositely positioned and adapted to lift and support a reel rotatably therebetween. Each support unit has retractible rollers operative to permit movement of the reei support units when the reel is not being supported thereby. A reel engaging unit carried upon telescopic members slidably engaged with each of the reel support units is adapted to facilitate rotation of the reel. At least one of the reel engaging units has a braking assembly operative to control reel rotation. A hydraulic jack is operative to cause upward movement of the telescopic members thereby occasioning lifting of the reel.

7 Claims, 4 Drawing Figures

FIG. 2
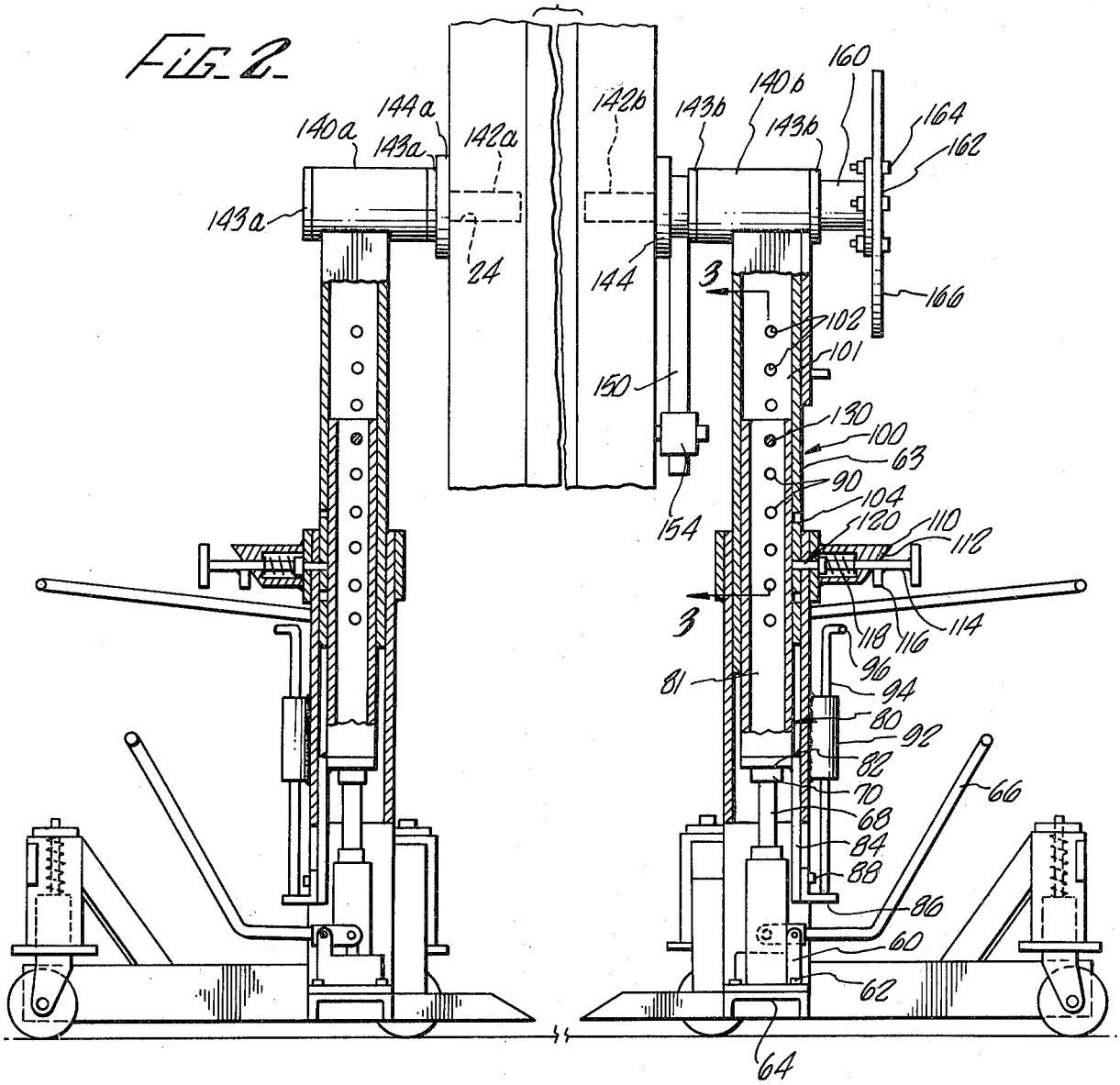
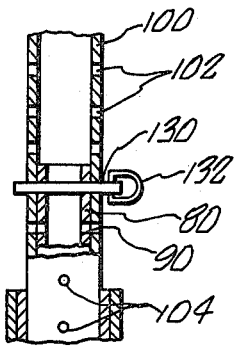
FIG. 3
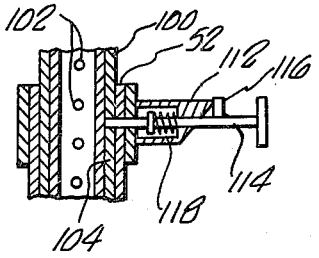
FIG. 4

PORTABLE REEL JACK STAND

BACKGROUND

This invention relates generally to reel stands, and in particular those useful in lifting and rotatably supporting a reel.

In many industrial applications it is necessary to provide reels having materials such as cable, rope, or sheet stock wound thereabout. Oftentimes these reels are extremely heavy when loaded and thus present considerable problems in effectively handling them to facilitate unwinding of the materials wound thereupon.

It is well known in the art that these reels may be supported by heavy trucks or other equipment which are necessarily occupied during the reel unloading stage. These trucks have means associated therewith for suspending the reel rotatably above the ground thereby facilitating unwinding of the materials. Because it may be economically undesirable to utilize a lift truck or other heavy machinery for these purposes, reel stands are well known in the art for their ability to provide a mechanism to unload the materials found on these reels.

These previous reel stands have the ability to be positioned with respect to the reel to facilitate the lifting or supporting of the reel from the ground. These reel stands are further adapted to permit rotation of the reel while being supported by the stand to facilitate dispensing of the materials wound thereupon. In many cases these prior art reel stands are U-shaped in design wherein the reel is supported between the oppositely positioned downwardly extending arms of the inverted U. These inverted U-shaped reel stands are difficult to handle and are inflexible with regard to the size of reels that may be supported thereby.

It is also known that reels of the nature described herein develop substantial rotational inertia during the unwinding process thus raising the possibility of an over pay-out of material. This over pay-out or more commonly known as slack has potentially hazardous effects on machinery using the materials wound upon the reel and also presents a dangerous hazard to workers operating the equipment unloading the reels. It is therefore known that a clutch member or braking means may be provided with the reel stand to control reel rotation.

In U.S. Pat. Nos. 1,693,876 to Unruh, 1,825,218 to Van Hook, 1,832,446 to Boe, 2,650,771 to Marion and 4,098,468 to Skalleberg, reel stands are described which are operative to support a reel off the ground and permit rotation of the reel to facilitate unwinding of the material contained thereon.

Similarly, in U.S. Pat. Nos. 2,215,651 to Pierce, 3,944,094 to Compton, 3,995,758 to Kovaleski and 4,030,704 to Bierle cable reel support structures are described which have a means to lift a reel off the ground and support it rotatably for unwinding operations.

These prior devices have many problems. For example, in many cases they are extremely cumbersome to operate, and unnecessarily expensive for the purposes intended. Moreover, these prior art devices are limited with regard to the size of reels that may be supported and lifted thereby. Further, very strong forces act upon the cross members of these previous stands which have a deleterious effect on the reel unloading operations. These prior art devices are also inflexible with regard to the height to which the reel may be raised.

Therefore, there is a need for an improved portable reel jack stand operative to lift and rotatably support a reel wherein the lifting means is indexed to selectively raise the cable reel in incremental distances and the reel jack stand has reel braking means operatively associated with the lifting means.

There is a further need to provide a reel jack stand having a plurality of telescopic members operative to lift a reel and rotatably support a reel, wherein a braking means is supported by the telescopic members.

There is an additional need to provide an improved reel jack stand operative to lift and rotatably support reels having a wide range of diameters and widths wherein the reel jack stand has braking assemblies associated therewith.

SUMMARY

Accordingly, an apparatus is disclosed which is operative to lift and rotably support a heavy reel having material wound thereabout, wherein the apparatus illustrates substantial advantages over those previously discussed.

In the preferred embodiment, dual reel support units, which are substantially identical, are positioned on opposite sides of the reel which is to be supported. The support units have retractable casters which facilitate proper positioning of the support units with respect to the reel. The support units can be spaced apart a considerable distance yet have the ability to effectively engage and lift a reel from the ground. The casters provided with the base platform of each reel support unit retract as the reel is being lifted, thereby leaving the base platform of each support unit to distribute the reel weight and stabilize the support units. Outwardly extending forks may also be provided with the base platforms to facilitate greater stability during reel lifting operations.

Attached to each support unit is a support tube which has the lifting elements enclosed therein. Disposed in the lowermost portion of the support tube of each reel support unit are hydraulic jacks or lifting means of the standard variety. Receivable into the support tube is a first telescopic member engageable with the hydraulic jack or lifting means and adapted to reciprocate within the support tube.

A second telescopic member also is slidably disposed within the support tube and is operative to support the reel engaging means. The second telescopic member has a plurality of apertures disposed along its length which apertures are designed to be aligned with similar apertures found in the first telescopic unit. By aligning the apertures and placing a pin therethrough the first and second telescopic members are simultaneously caused to moved upward upon action by the hydraulic jack.

A second set of apertures are also located in the second telescopic member and are adapted to receive an indexing means which is operative to support the second telescopic member within the support tube irrespective of its engagement with the first telescopic member. When the indexing means is operative, by removing the support pin from the first and second telescopic members, the first telescopic member is repositionable to a lower position in the support tube. By then realigning the apertures in the first and second telescopic members and removing the indexing means the combination of first and second telescopic members may again be lifted by the hydraulic jack until a desired height is achieved. At this point the indexing means may again be made operative with the second telescopic member to assist in the support of the entire weight of the reel.

Disposed atop the second telescopic member are bearing housings operative to rotatably support spindle assemblies, which are receivable into the mandrel apertures at the reel and operative to rotatably support the reel.

Connected to at least one of the spindle assemblies is a disk brake assembly which is selectively operable to retard rotation of the spindle assembly. Secured to the same spindle assembly, which has the disk brake assembly connected therewith, is a braker arm which attains a position next to one of the side flanges of the reel. Slidably engaged with the braker arm is a pin which is receivable into one of the apertures disposed along the reel side flange. By controlling the rotation of the spindle assembly, the braker arm is caused to slow down its rotation, thereby imparting a counter rotational torque to the engaged reel side flange thus controlling reel rotation.

These and other features and advantages of the present invention will become apparent from the following description and claims when read in connection with the accompanying drawings.

BRIEF DESCRIPTION OF THE DRAWINGS

The invention can be easily understood from reading the description of the preferred embodiment and by reference to the accompanying drawings, wherein:

FIG. 2 is a front cross-sectional view of the reel support units taken on line 2—2 of FIG. 1 illustrating the slidable engagement of the plural telescopic members and the hydraulic jack useful to lift the reel engaging structures.

FIG. 3 is a side cross-sectional view taken on line 3—3 of FIG. 2 illustrating the engagement of the first and second telescopic members.

FIG. 4 is a front cross-sectional view of the indexing means show in FIG. 2 illustrating the position of the indexing means when not being utilized to support the second telescopic member.

DESCRIPTION OF THE PREFERRED EMBODIMENT

Figure 1:
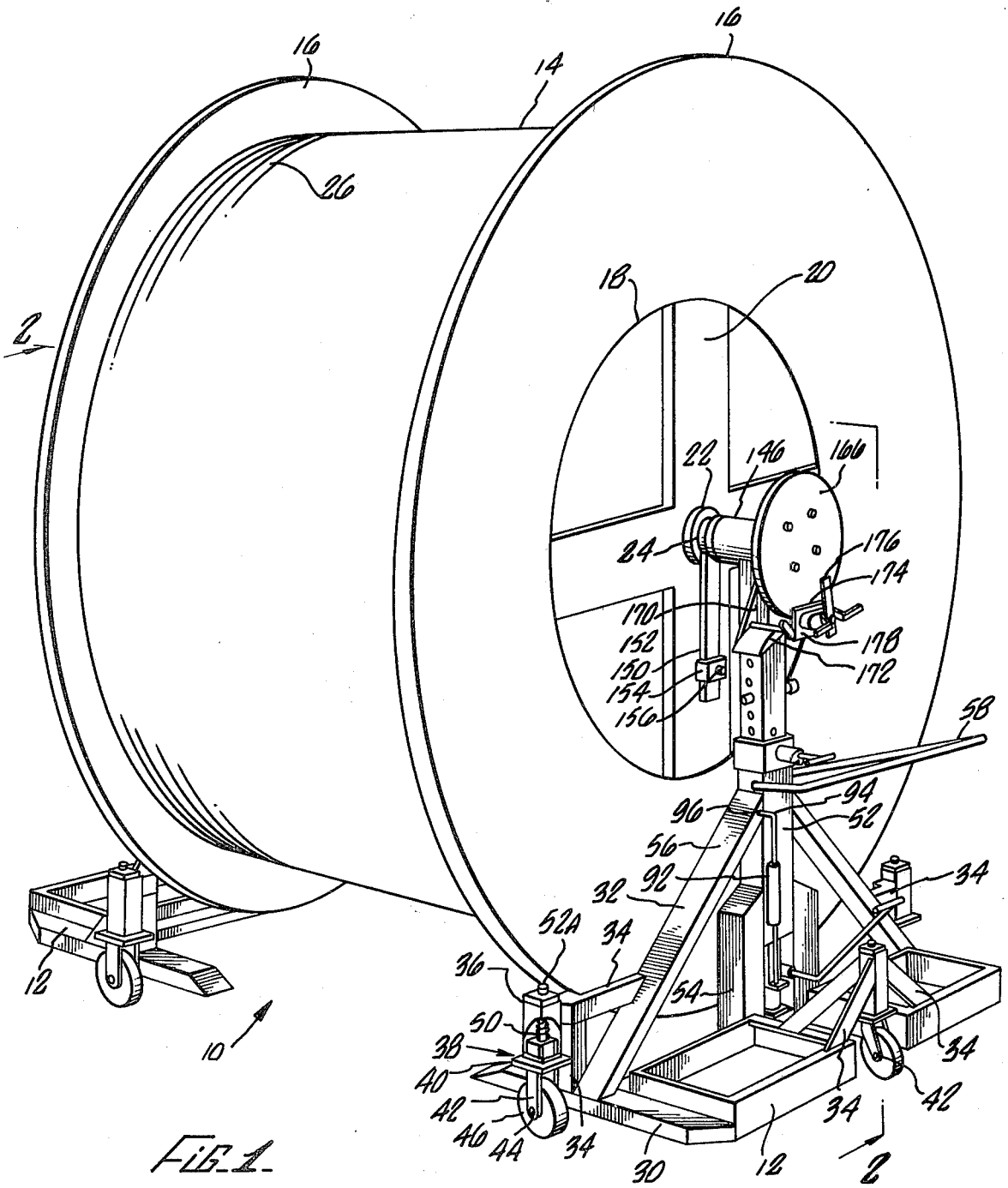
FIG. 1 is a perspective view illustrating an embodiment of the reel jack stand constructed in accordance with the present invention, wherein the jack stand has lifted and supported a reel.

With reference to the figures, wherein similar structures are identified with similar numerals in the various figures, a new reel jack stand according to the present invention is shown and generally designated by a numeral 10.

The stand 10 has oppositely positioned portable reel support units 12, which, save minor exception, are identical. Therefore, only one of the reel support units 12 will be described in great detail. It should be understood that the other reel support unit 12 operates in a similar manner. Only structures unique to one of the reel support units 12 will be identified as such and described in greater detail.

Disposed between the reel support units 12 is a reel 14 having oppositely facing side flanges 16 which each define a central core section or hub 18. A plurality of metal spokes 20 are provided within the hub 18, the spokes 20 meeting at the centermost portion of each hub 18 to form oppositely positioned core sections 22. Defined within the core section 22 of each of the side flanges 16 are mandrel apertures 24 which are coaxial to facilitate symmetrical rotation of the reel 14 and consequent dispensing of the material 26 contained thereon. Reels 14 of the nature described herein range in height up to nine feet and in width up to six or seven feet. The reel support units 12 are adapted to receive at least reels of this nature and size.

The invention of the present application is particularly suited for supporting reels of cable wherein said cable is to be unwound and loaded on supply reels (not shown) for cable dispensing operations. It is known that loaded reels of this type may weigh in excess of 17,000 lbs.; therefore, the reel support units 12 should be made of materials adapted to support weights of that magnitude.

The reel support units 12 are positionable about both side flanges 16 of the reel 14. Because of their compact design, the reel support units 12 are easily fitted in between reels despite the crowded condition of the warehouse facility. In a preferred embodiment, the units 12 have base platforms 30 with dual forks 32 extending outwardly therefrom, wherein the forks 32 are adapted to fit about the opposing side flanges 16 and stabilize the reel support units 12 to prevent their tipping either under their weight of the reel 14 or during movement to engage the reels 14.

A plurality of braces 34 rigidly support caster housings 36 disposed along the base platform 30 of each support unit 12. Although in the preferred embodiment there are three caster housings 36 illustrated, it should be understood that additional caster housings 36 may be provided without departing from the spirit of the invention. Slidably disposed within each of the caster housings 36 is a caster assembly 38 which comprises a platform section 40 with dual flanges 42 extending downwardly therefrom. An axle 44 disposed between the flanges 42 rotatably supports a wheel 46 adapted to move in a 360 degree circle. A spring 50, shown in phantom in FIG. 1, is wound about a post 52A which is integral with the platform 40 and is operative to bias the platform section 40 away from the caster housing 36 when the support units 12 are not loaded with a reel 14. Therefore, in the unloaded state the caster assemblies 38 are operative to provide pivotal movement of the reel support units 12 to facilitate their positioning about the reel 14.

It is desirable to distribute the weight of the reel 14 over a greater area than that provided by the wheels 48 associated with the caster assemblies 38. Therefore, the caster assemblies 38 retract into the caster housings 36 causing the base platform 30 to become flush with the ground thereby receiving the entire weight of the reel 14. As will be described hereinafter, the caster assemblies 38 will retract into the housings 36 during the course of the reel lifting operation.

Substantially in the center of the base platform 30 is an upwardly extending support tube 52 which is held in place by oppositely positioned columns 54 welded thereto. A pair of angled yokes 56 are welded to the base platform 30 and the support tube 52 and are operative to prevent lateral deformation of the tube 52. A handle 58 is fitted onto the support tube 52 or is welded to the yokes 56 and is useful in providing the operator with a means to position the reel support units 12 with respect to the reel 14.

As best illustrated in FIG. 2, disposed within the area below the support tube 52, and in between the columns 54, is a hydraulic jack 60 removably secured to the base platform 30 by bolts 62 or other conventional means. The undersection 64 of the base platform 30 below the hydraulic jack 60 is reinforced to aid in supporting the reel weight. A jack handle 66 is engaged with the hydraulic jack 60 and is operative in an upward/downward movement to occasion hydraulic pumping action and consequent movement of a hydraulic cylinder 68 and associated head 70. Although in the preferred embodiment a hydraulic jack 60 is illustrated, it should be understood that other lifting means, such as compressed air cylinders, may be provided to accomplish the same result. Relief means (not shown), as well known in the art, are provided with the hydraulic jack 60 to occasion venting of the hydraulic pressure and consequent downward movement of the hydraulic cylinder 68.

The support tube 52 is elongated, substantially square in cross-section and hollow to receive the other lifting elements. Each of the columns 54 and the yokes 56 may be either hollow or solid depending upon the desired strength of the reel support units 12.

An elongated first telescopic member 80 square in cross-section is sized to fit within the support tube 52, wherein a discreet space is provided between the periphery of the member 80 and the inside of the support tube 52. An L-shaped platform 82 attached to the member 80 has a downwardly extending flange 84 which is sized to fit within the area in front of the hydraulic jack 60. A bracket 86 is removably secured to the flange 84 by bolts 88 or other equivalent means, whereby the bracket 86 is installable on the flange 84 when the first telescopic member 80 is disposed within the support tube 52. Defined within the opposing parallel sides 81 of the telescopic member 80 are a plurality of spaced apart apertures 90 which are adapted to receive a bolt of a diameter sufficient to support in shear reels of the aforementioned nature.

In the preferred embodiment the apertures 90 are defined within the sides of the first telescopic member which face away from the reel 14 when disposed between the support units 12. It is important that the apertures 90 be defined within the sides 81 in equally spaced-apart distances to facilitate proper utilization of the first telescopic member 80 in coordination with the other lifting elements as will be described hereinafter.

Secured longitudinally to the support tube 52 and facing toward the operator is a sleeve 92 which is adapted to receive a pusher rod 94 having a bent-over handle 96. The rod 94 is fitted within the sleeve 92 to provide for its contact with the bracket 86 to facilitate the application of a downwardly directed force to cause the telescopic member 80 to move downwardly when not supported by the hydraulic jack 60 or when not connected to other elements of the lifting mechanism as will be described hereinafter.

A second telescopic member 100 is sized to fit within the support tube 52 and around the first telescopic member 80. A plurality of spaced apart apertures 102 are disposed along the sides 101 of the second telescopic member 100 which are parallel to the sides 81 of the first telescopic member 80 having the apertures 90 disposed therein. The apertures 102 are of a sufficient diameter to receive a pin and are spaced along the sides 101 to facilitate alignment with the apertures 90 spaced along the sides 81. A second set of apertures 104 is defined within the side 103 of the second telescopic member 100 which faces the operator.

An indexing channel 110 is welded to the uppermost portion of the support tube 52. The channel 110 has a slanted end portion 112 useful to inform the operator of the relative position of a pin 114 which is receivable into the channel 110 and disposed therethrough. The pin 114 further has a bar 116 welded thereto, the bar 116 adapted to rotate with said pin 114 and follow the contour of the end portion 112. It should be apparent that rotation of the bar 116 will cause the pin 114 to move outwardly from the channel 110. A spring 118 is fitted within the channel 110 and is provided to bias the pin 114 toward the inside of the support tube 52. An aperture 120 provided in the support tube 52 is sized to permit passage of the pin 114 therethrough. In the operative state the pin 114 is thus selectively fitted through both the aperture 120 and one of the apertures 104 in the second telescopic member 100.

In the inoperative state, as shown in FIG. 4, the pin 114 has been rotated within the channel 110 wherein the bar 116 is juxtaposed the apex of the slanted portion 112 thereby disengaging the pin 114 from the second telescopic member 100. By again rotating the pin 116, the bar will follow the contour of the slanted end portion 112 under action of the spring 118 occasioning the reinsertion of the pin 114 through the aperture 120 and into one of the apertures 104 of the second telescopic member 100. It should be apparent to those skilled in the art that other biasing means may be provided to replace the spring 118, however, in the preferred embodiment a spring 118 is illustrated because of its adaptability to constructions of this nature.

As best shown in FIG. 3, a pin 130 and associated wire 132 may be used to selectively coordinate the lifting movements of both the first telescopic member 80 and the second telescopic member 100. The relationship between the first telescopic member 80 and the second telescopic member 100 to facilitate lifting of the reels 14 will be described hereinafter. It should be noted however that the pin 130 must be sized to fit between both the apertures 102 and the apertures 90 when they are aligned.

Fitted to the uppermost section of one of the second telescopic members 100 is a bearing housing 140*a* which is adapted to rotatably support a spindle assembly 142*a*. The housing 140*a* has a plurality of bearings (not shown) placed therein and a spacer ring 144*a* disposed about the spindle assembly 142*a*. Sealing rings 143*a* may be provided with the bearing housing 140*a* to maintain the bearings therein. Fittings (not shown) may also be provided with the bearing housings 140*a* to facilitate lubrication of the bearings contained therein. The spindle assembly 142*a* is adapted to fit partially within the mandrel hole 24 of a reel 14 to facilitate rotation of the reel 14. It should be noted that the spindle assembly 142*a* may have a portion frustoconical in design with a plurality of longitudinal splines (not shown) disposed about the periphery. This is useful in securely maintaining the spindle assembly 142*a* within the mandrel hole 24.

A second bearing housing 140*b*, rigidly connected to the other second telescopic member 100, has a spindle assembly 142*b* rotatably supported thereby. The bearing housing 140*b* also has a plurality of bearings (not shown) disposed therein and adapted to facilitate rotation and support for the spindle assembly 142*b*. A second spacer ring 144*b* is also receivable upon the spindle assembly 142*b* and may be immovably secured thereto. Sealing rings 143*b* are also provided with the bearing housing 140b to maintain the bearings therein. Appropriate grease fittings (not shown) may also be provided with the bearing housing 140b to facilitate lubrication of the bearings therein.

Placed along the spindle assembly 142b and rigidly secured thereto by conventional means such as a set screw or bolt, a braker arm 150 extends parallel to one of the side flanges 16 of the reel 14. As best shown in FIG. 1, the braker arm 150 has a slot 152 defined within its centermost section and extending substantially the entire length of the braker arm 150. Fitted about the braker arm 150 is a slidably engaged locking clip 154 with apertures (not shown) defined within its opposing sides. Receivable into the apertures defined within the locking clip 154 is a braker pin 156 which is of sufficient length to pass completely through the clip 154 and enter apertures (not shown) defined within the spokes 20 associated with each side flange 16. In this manner the braker arm 150 rotates with the reel 14 and spindle assembly 142b.

Oppositely positioned with respect to the braker arm 150, a sleeve 160 fits about the portion of the spindle assembly 142b which has passed through the bearing housing 140b. The sleeve 160 is secured to the spindle assembly 142b by conventional means to assure proper engagement, such as set screws or bolts. A plate 162 having a plurality of radially spaced apart apertures (not shown) is attached to the sleeve 160. Fitted to the plate 162 by bolts 164 disposed through the apertures in the plate 160 is a disk 166 of the variety utilized with a disk brake assembly. Wide variation may be accepted in the size of the disk 166 without departing from the spirit of this invention.

Referring again to FIG. 1, a skirt 170 integral with and extending downwardly from the bearing housing 140b is operative to support a disk brake assembly as will be described hereinafter. The skirt 170 has oppositely positioned mounts 172 which are adapted to receive and maintain a standard caliper assembly 174 utilizable with a disk brake type assembly. Details of the disk brake assembly are well known to those skilled in the art, therefore, they need not be described herein. However, means are provided wherein by rotating the handle 176, the pucks 178 of the caliper assembly 174 will move toward each other thus creating contact between the disk brake pads (not shown) and the disk 166 to facilitate a braking action on the disk 166 and innerconnected spindle assembly 142b.

The braking action on the spindle assembly 142b will result in a torque being applied by the braker arm 150 which is counterrotational to the rotation of the reel 14. In this manner it is possible to control reel rotation and thereby material payout. It should be apparent that a similar braking assembly may also be provided with the bearing housing 140a to facilitate a braking torque being applied to both sides of the reels 14. It should also be apparent that a clutch mechanism may be employed to control reel rotation.

In operation, the portable reel jack stand 10 of the present invention is readily adaptable to reels 14 of various sizes. Briefly, the reel support units 12 are moved to opposite sides of the reel 14 wherein they are placed substantially parallel to the side flanges 16 of the reel 14. The forks 32 are disposed on either side of the reel 14 wherein it makes contact with the ground.

To utilize the reel support units 12 to facilitate lifting of a reel 14, the indexing pin 114 is first rotated so that the bar 116 is pointed upwardly. This action forces the pin 114 to become disengaged with the second telescopic member 100 which is then free for upward movement. The jack handle 66 is then moved upwardly and downwardly in accordance with standard hydraulic pumps to facilitate the build-up of hydraulic pressure and associated movement of the hydraulic cylinder 68.

Movement of the cylinder 68 occasions upward movement of both the first telescopic member 80 and second telescopic member 100 because initially the second telescopic member 100 is supported by the L-shaped platform 82 which is integral with the first telescopic member 80. The indexing pin 114 is then rotated so that under action of the spring 118 it will move into one of the apertures 104 defined within the side 103 of the second telescopic member 100. After the pin has engaged the second telescopic member 100, the member 100 will be firmly supported within the support tube 52 whereby it may not move downward. The hydraulic jack 60 is then relieved of its hydraulic pressure so that the first telescopic member 80 is free to be moved downwardly under action of the rod 94 on the bracket 86.

When the first telescopic member 80 has been forced to its lowermost position within the support tube 52, a pin 130 is placed into the aligned apertures 102 and 90 as illustrated in FIGS. 1 and 3. By then rotating the pin 114 as shown in FIG. 4, the second telescopic member 100 is again supported by the first telescopic member 80 and is free to move upward with the first telescopic member 80 under action of the hydraulic jack 60. This process is performed a multitude of times with each reel support unit 12 until the spindle assemblies 142a, b are at the height of the mandrel holes 24 defined within the side flanges 16 of the reel 14. The uniform locations of the apertures 90, 102 within the opposing support units 112 will assure the operator that the reel 14 is supported whereby its axis of rotation is substantially parallel to the ground thus facilitating safe dispensing of the material wound thereabout.

At this point the roll support units 12 are forced toward each other thereby causing the spindle assemblies 142a, b to move partially into the mandrel holes 24. It should be apparent that the spindle assemblies 142a, b may be of various lengths depending upon the exact type of reel that is to be supported between the reel support units 12. By then repeating the process as defined hereinabove wherein the pins 130 are selectively utilizable to engage the first telescopic member 80 with the second telescopic member 100 to facilitate lifting of the second telescopic member, the reel 12 is thus lifted from the ground. As indicated previously, when the reel 14 is lifted, the weight of the reel 14 occasions an opposite force to that of the springs 50 thus causing the caster assemblies 38 to move into the housings 36. When the caster assemblies 38 have fully moved in to the housings 36 the weight of the reel 14 will be entirely supported and distributed to the base platforms 30.

When the desired height of the reel 14 is achieved, the one inch pin 130 utilized to connect the first and second telescopic members is replaced by a $\frac{7}{8}$ inch pin (not shown) which in coordination with the indexing pin 114 is operative to support the entire weight of the reel 14, thus relieving the pressure on the seals (not shown) of the hydraulic jack 60.

During the cable dispensing operations, the disk brake assembly may be operated in a customary manner to control reel rotation and material pay-out.

The reel support units 12 constructed in accordance with the present invention are extremely easy to use, compact and able to withstand considerable loads. They are also useful with a wide variety of reels, virtually independent of reel size or diameter. The unique interaction of the first telescopic member 80 and second telescopic member 100 operative with the support tube 52 provides the ability to support reels 14 of a substantially larger radius than the height of the support tube 52. It is also possible to support reels of a smaller radius, but which need to be maintained at a considerable distance off the ground by simply taking advantage of the telescopic features of the lifting mechanisms associated with the reel support units 12.

While the preferred embodiment of the present invention has been described in great detail and in very specific terms, such description is for illustrative purposes only. It is to be understood that changes, modifications and colorable variations may be made without departing from the spirit and scope of the following claims.

What is claimed is:

1. An apparatus adapted to lift and support a reel of cable or the like off the ground, the apparatus further adapted to facilitate rotation of the reel, the apparatus comprising:

(A) dual oppositely positioned reel support units, each support unit comprising:

(i) a plurality of rollers affixed to each reel support unit, the rollers retractable into the support units when the support units have lifted the reel from the ground, the rollers adapted to facilitate movement of the reel support units when not retracted, (ii) a first telescopic member slidably engaged with each of the reel support units, (iii) a second telescopic member slidably engageable with the first telescopic member, the second telescopic member including means for engaging the first telescopic member to support the reel above the ground;

(iv) means for imparting a lifting force on the first telescopic member, (v) indexing means for supporting the first telescopic member and the reel, and (vi) means for engaging the reel, the engaging means affixed to the second telescopic member, the engaging means adapted to facilitate rotation of the reel when lifted from the ground, and (B) means for braking rotation of the reel, the braking means including a disk brake assembly operative with at least one of the reel engaging means to occasion braking of the reel.

2. The apparatus of claim 1, wherein the reel engaging means includes a rotatable spindle assembly receivable into the reel.

3. An apparatus for lifting a reel of cable or the like from the ground, the apparatus adapted to rotatably support the reel when lifted from the ground, the apparatus comprising:

(A) dual reel support units, each reel support unit comprising:

(i) means for permitting movement of the reel support unit along the ground, the movement permitting means being inoperative when the reel is lifted from the ground;

(ii) means for engaging the reel, the engaging means adapted to facilitate rotation of the reel supported by the reel support unit;

(iii) a lift for raising the engaging means, the lift supported by the movement permitting means, the lift comprising:

(a) first telescopic member supported within the reel support unit, (b) second telescopic member supported by the first telescopic member, (c) a hydraulic jack operative to raise the first telescopic member, and (d) means for selectively connecting the first telescopic member to the second telescopic member, whereby movement of the first telescopic member by the hydraulic jack selectively raises the second telescopic member; and (B) means for controlling the speed of rotation of the reel, the control means being supported by one of the engaging means.

4. The apparatus of claim 3 wherein each reel support unit comprises a frame having a base platform and the means for permitting movement of the reel support unit comprises roller means attached to the base platform, and wherein each reel support unit includes means for biasing the roller means to extend to the ground, wherein the roller means are caused to retract into the base platform when the reel is lifted from the ground due to the weight of the reel.

5. The apparatus of claim 3, wherein the means for controlling the speed of rotation comprises a brake assembly, the brake assembly comprising:

a disk attached to one of the engaging means;

a caliper assembly adapted to receive the disk;

means for imparting a force upon the caliper assembly to occasion the application of a braking force on the disk;

whereby the application of a braking force upon the disk causes the application of a braking force upon the reel.

6. The apparatus of claim 5, wherein the brake assembly further includes means receivable into the reel for imparting a force opposite the direction of rotation of the reel, the force imparting means being attached to the engaging means.

7. The apparatus of claim 3, wherein each reel engaging means includes a spindle assembly receivable into the reel and a bearing housing to facilitate rotation of the spindle assembly.

* * * * *